US006644666B1

(12) United States Patent
Tamura et al.

(10) Patent No.: US 6,644,666 B1
(45) Date of Patent: Nov. 11, 2003

(54) CARD GAME

(75) Inventors: Steve Tamura, Kirkland, WA (US); Ronald Furuta, Seattle, WA (US)

(73) Assignee: Tamura Gaming Enterprises, Inc., Seattle, WA (US)

( * ) Notice: Subject to any disclaimer, the term of this patent is extended or adjusted under 35 U.S.C. 154(b) by 0 days.

(21) Appl. No.: 10/029,376

(22) Filed: Dec. 21, 2001

Related U.S. Application Data

(60) Provisional application No. 60/291,207, filed on May 15, 2001, and provisional application No. 60/258,748, filed on Dec. 29, 2000.

(51) Int. Cl.[7] ..... A63F 1/00

(52) U.S. Cl. ..... 273/292; 273/274; 273/303; 273/309; 463/12; 463/13

(58) Field of Search ..... 273/292, 274, 273/303, 309; 463/12, 13

(56) References Cited

U.S. PATENT DOCUMENTS 5,224,706 A * 7/1993 Bridgeman et al. ..... 463/13
5,397,128 A * 3/1995 Hesse et al. ..... 273/292
5,720,483 A * 2/1998 Trinh ..... 273/292
5,782,473 A * 7/1998 Chou et al. ..... 273/292
5,788,241 A * 8/1998 Ung ..... 273/292
5,871,213 A * 2/1999 Chadband et al. ..... 273/292
6,050,569 A * 4/2000 Taylor ..... 273/292
6,062,565 A * 5/2000 Chadband et al. ..... 273/292
6,312,334 B1 * 11/2001 Yoseloff ..... 463/25
6,386,973 B1 * 5/2002 Yoseloff ..... 463/13

* cited by examiner

*Primary Examiner*—Benjamin H. Layne
*Assistant Examiner*—Dolores Collins
(74) *Attorney, Agent, or Firm*—Townsend and Townsend and Crew, LLP

(57) ABSTRACT

The game typically comprise dealing a number of cards, typically five cards, to each of the players and dealer. In a first phase, the player attempts to make a qualifying hand. To make a qualifying hand, the player must use three of the five dealt cards to equal a predetermined point total, typically a total of 10, 20, or 30. If the player is able to make a qualifying hand, the player moves onto a second phase of the game and takes the two remaining cards to create a point hand that will be compared against the dealer's point hand. In the second phase, if the player's point hand is superior to the dealer's point hand, the player will win. However, if the dealer has a superior point hand, the player loses his wager(s). If the dealer and the player have an equal point hand, the game is considered a "push."

19 Claims, 6 Drawing Sheets

| Hand | Payout 1 | Payout 2 | Payout 3 | Payout 4 | Payout 5 | Payout 6 | Payout 7 | Payout 8 | Payout 9 |
|---|---|---|---|---|---|---|---|---|---|
| Five of a Kind | 5000 | 5000 | 5000 | 5000 | 5000 | 5000 | 5000 | 1500 | 1500 |
| Natural Royal Flush | 5000 | 5000 | 5000 | 5000 | 5000 | 5000 | 5000 | 1000 | 1000 |
| Wild Royal Flush | 2000 | 2000 | 2000 | 2000 | 2000 | 2000 | 2000 | 500 | 750 |
| Natural Straight Flush | 1000 | 500 | 500 | 500 | 500 | 1000 | 1000 | 500 | 500 |
| Wild Straight Flush | 1000 | 500 | 500 | 500 | 500 | 1000 | 1000 | 500 | 500 |
| Four of a Kind | 250 | 250 | 250 | 200 | 250 | 500 | 500 | 250 | 100 |
| Full House | 50 | 100 | 100 | 100 | 100 | 70 | 75 | 50 | 50 |
| Flush | 25 | 25 | 25 | 50 | 50 | 50 | 50 | 20 | 15 |
| Straight | 10 | 10 | 15 | 12 | 15 | 10 | 15 | 7 | 10 |
| Three of a Kind | 5 | 5 | 5 | 5 | 5 | 5 | 5 | 3 | 3 |
| Two Pairs | 3 | 3 | 3 | 3 | 3 | 3 | 3 | 2 | 2 |
| Pair of Aces | -1 | -1 | -1 | -1 | -1 | -1 | -1 | -1 | -1 |
| Pair of Jacks to Kings | -1 | -1 | -1 | -1 | -1 | -1 | -1 | -1 | -1 |
| Pair of Eights to Pair of Tens | -1 | -1 | -1 | -1 | -1 | -1 | -1 | -1 | -1 |

| Hand | Payout 10 | Payout 11 | Payout 12 | Payout 13 | Payout 14 | Payout 15 | Payout 16 | Payout 17 | Payout 18 |
|---|---|---|---|---|---|---|---|---|---|
| Five of a Kind | 2500 | 3000 | 3000 | 3000 | 3000 | 3000 | 1500 | 1500 | 3000 |
| Natural Royal Flush | 1500 | 2000 | 2000 | 2000 | 2000 | 2000 | 1000 | 1000 | 2000 |
| Wild Royal Flush | 1000 | 1000 | 1000 | 1000 | 1000 | 1000 | 800 | 800 | 1000 |
| Natural Straight Flush | 500 | 750 | 750 | 750 | 750 | 750 | 700 | 700 | 750 |
| Wild Straight Flush | 500 | 750 | 750 | 500 | 500 | 500 | 500 | 500 | 500 |
| Four of a Kind | 100 | 100 | 100 | 100 | 100 | 100 | 250 | 250 | 100 |
| Full House | 75 | 75 | 75 | 75 | 60 | 60 | 50 | 50 | 60 |
| Flush | 25 | 25 | 25 | 25 | 25 | 25 | 20 | 20 | 25 |
| Straight | 15 | 15 | 15 | 15 | 10 | 10 | 7 | 7 | 10 |
| Three of a Kind | 3 | 3 | 3 | 3 | 4 | 4 | 3 | 3 | 4 |
| Two Pairs | 2 | 2 | 2 | 2 | 2 | 2 | 2 | 2 | 2 |
| Pair of Aces | 1 | 1 | 1 | 0 | 1 | 0 | 1 | 0 | 1 |
| Pair of Jacks to Kings | -1 | -1 | 1 | 0 | 1 | 0 | 1 | 0 | 1 |
| Pair of Eights to Pair of Tens | -1 | -1 | -1 | -1 | -1 | -1 | -1 | -1 | 1 |

FIG. 6

CARD GAME

CROSS-REFERENCES TO RELATED APPLICATIONS

The present application claims benefit under 37 C.F.R. § 1.78 of Provisional Patent Application Ser. No. 60/258,748, filed Dec. 29, 2000 and Provisional Patent Application Ser. No. 60/291,207, filed May 15, 2001, the complete disclosures of which are incorporated herein by reference.

The present application is also related to Design patent application Ser. No. 29/141,349, filed May 4, 2001, the complete disclosure of which is also incorporated herein by reference.

BACKGROUND OF THE INVENTION

The present application relates generally to a multiple player game of chance. More particularly, the present invention relates to a card game or tile game that can be played in a multiple person table in a casino or electronically as a computer game in a casino.

Gambling continues to be a growing and very lucrative business within the United States and abroad. Players are drawn to casinos for the excitement and the chance of winning large amounts of money. With the proliferation of casinos in Las Vegas, Atlantic City, Reno, and other cities and Indian reservations across the country, it is important that the casinos continue to innovate in order to distinguish themselves from other casinos. While most casinos have multi-player games such as poker, blackjack, pai-gow, craps, baccarat, roulette, in which each bring a different type of excitement and payouts to the players (and the casinos), almost every casino has the same standard games, and it is difficult for each of the casinos to separate themselves from the other casinos.

There is still a growing need for new, dynamic, and exciting games to draw in customers to the casino and to separate the particular casino from the competing casinos. One proposed casino-style game is described in U.S. Pat. No. 5,782,473 entitled "Method of Playing A Big Ten Card Game." The Big Ten card game is a multiple player card game that utilizes a five card hand in which the player attempts to show three cards from his hand which add up to either ten, twenty, or thirty. The remaining two cards are compared against the dealer's two remaining cards to determine the winner. Unfortunately, the Big Ten Game is impractical for playing in a casino. In particular, the Big Ten Game provides only a single opportunity to place a wager, which limits the amount the player and casino may win per round and reduces the level of excitement of the game. Additionally, because the games has a complicated method of breaking ties, the play of the game is further slowed. Since each of the game tables takes up valuable floor space in the casino and because players generally do not have the patience to learn a complicated casino game, it is preferable that the game be simple as possible for the player and dealer to play and to determine the winner.

Therefore, what is needed is an exciting, yet straight forward casino-style game that provides multiple opportunities for the player to place a wager.

BRIEF SUMMARY OF THE INVENTION

The present invention provides a simple, multiple player casino-style game that provides each of the players multiple opportunities to place a wager so that the player and the casino have increased opportunities to win.

The game generally comprise dealing a number of cards, typically five cards, to the dealer and each of the players at the table who have placed a wager. In a first phase of the game, the player must determine if he can make a qualifying hand.

A qualifying hand is defined as a hand that is able to make a target number with a specified subset of the dealt cards. In exemplary embodiments, a player must use any three of the five dealt cards to make a sum of ten, twenty or thirty. For example, if a player is dealt a hand comprising a 3 card, a 7 card, a 9 card, a 10 card, an ace card. The player can use the 3 card, 7 card, and the 10 card so as to make a qualifying hand with a point total of 20. The remaining two cards (e.g., the 9 card and the ace card) are considered to be the point hand that will be compared against the dealer's point hand.

It should be appreciated however, that in other embodiments of the present invention, totals other than 10, 20, or 30 can be used. For example, it may be possible to modify the game to try to get a point total of 11, 21, or 31.

After the player is able to make the qualifying hand, the player moves onto a second phase of the game and attempts to compare his point hand against the dealer's point hand.

If the dealer is also able to make a qualifying hand, the dealer and player compare the values of their point hands. If the player's point hand is superior to the dealer's point hand, the player will win. If the dealer has a superior point hand, the player loses his wager. If the dealer and the player have an equal point hand, the game is considered a "push."

If the dealer is unable to make a qualifying hand, the player will typically win even money on the wager that he placed.

In an exemplary aspect of the present invention, various betting schemes are provided that can allow the player to place a variety of different wagers on different aspects of the game so as to increase the excitement and to increase the amount of money played per hand. For example, the player may place an ante wager to receive the cards, a second wager after reviewing the cards (e.g., a "play wager") to inform the house that he intends to stay in the game, a "poker hand" wager, and other optional wagers. Advantageously, the multiple wagers can increase the amount of money wagered on a single hand by each of the players. Moreover, allowing the player to place optional wagers allows both novice players to place only the basic wagers, while expert gamblers will have the ability to place the more complex wagers, if desired.

The wagers bet on different aspects of the game. For example, the first wager or ante, can be placed by the player to receive the cards. After the player has reviewed the cards, if the player has a qualifying hand or if the player chooses to "bluff" (e.g., the player has a non-qualifying but is hoping that the dealer is unable to make a qualifying hand), the player can place the second wager, otherwise known as the play wager, to confirm his desire to stay in the hand. The poker bonus wager can be used to wager on an independent aspect of the game that is completely separate from the players ability to make 10, 20 or 30 with three of their cards. Thus, even if the player is unable to make a qualifying 10, 20, or 30 with the hand, the player can still salvage his hand if he can make a qualifying poker hand with his cards (i.e., a pair, two pairs, three of a kind, a straight, a flush, a full house, four of a kind, a straight flush, or the like).

The games of the present invention can use different mediums, such as tiles, dominoes, one or more standard decks of cards, or for use in an electronic form—either in the casino, other gambling establishments, as computer software, or for play over a network, such as the internet. Thus, as used herein, the term "cards," unless specified otherwise, shall be meant to encompass a variety of mediums. It should be appreciated that in some methods, the cards can include wild cards, such as jokers, which can be designated to be used to help the player complete a straight, flush, full house, four of a kind, or even to help the player make 10, 20 or 30, if desired. The house will typically be given the option as to how the wild cards are to be used in the game that is played in their casino.

To make the game easier and to increase the amount of players that will come to the table, the game is kept as simple as possible. The value of the cards can be valued as in baccarat: aces are 1 point, 2 through 9 have face value, and tens and face cards are worth 10. Thus, while more "pushes" or ties will result, because the game is easier to understand for the novice gambler, it will likely draw more players to the table. No comparison of face cards or suits of the face cards are needed. However, it will be appreciated that if a higher degree of difficulty is desired for the more advanced players, the present invention can be modified to incorporate such intricacies into the game.

BRIEF DESCRIPTION OF THE DRAWINGS

FIG. 6 illustrates some exemplary payout schedules for a poker bonus wager;

DETAILED DESCRIPTION OF THE INVENTION

Figure 1:
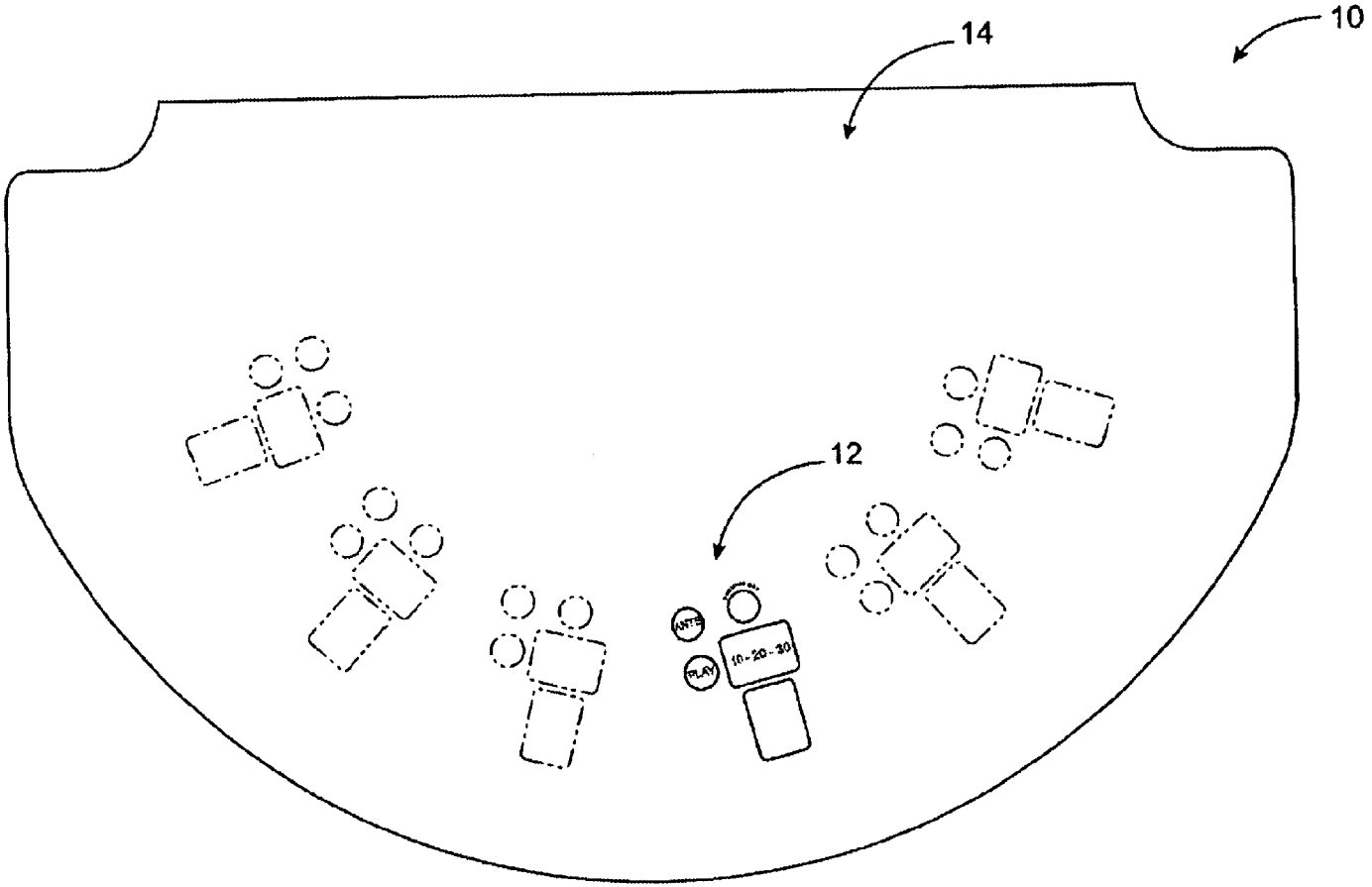
FIG. 1 illustrates an exemplary table layout of the present invention.

FIG. 1 illustrates an exemplary table layout of the present invention. The illustrated table layout 10 includes six stations 12 for players and a station 14 for a dealer. It should be appreciated however, that in other embodiments, the table may have more or less player stations for the table.

Figure 3:
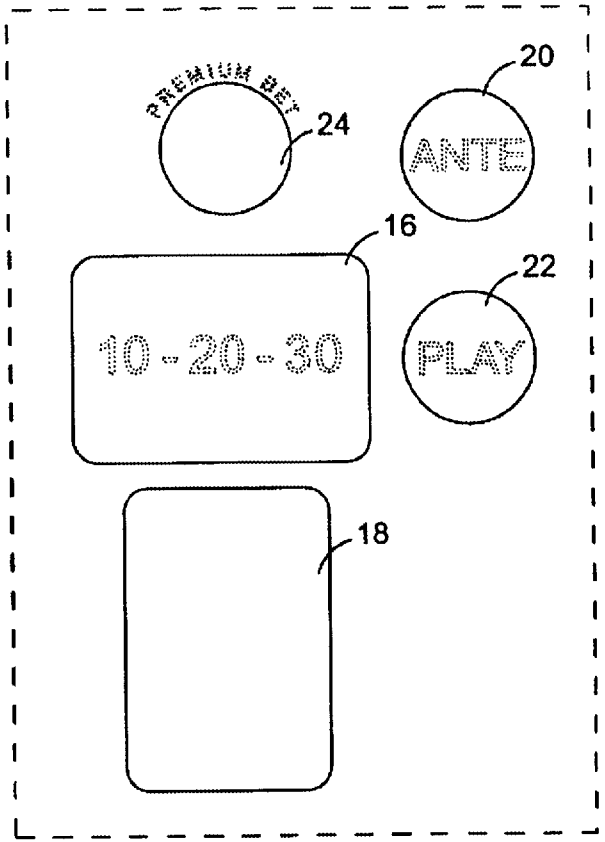
FIGS. 2 and 3 illustrates an exemplary player station of the present invention.
Figure 2:
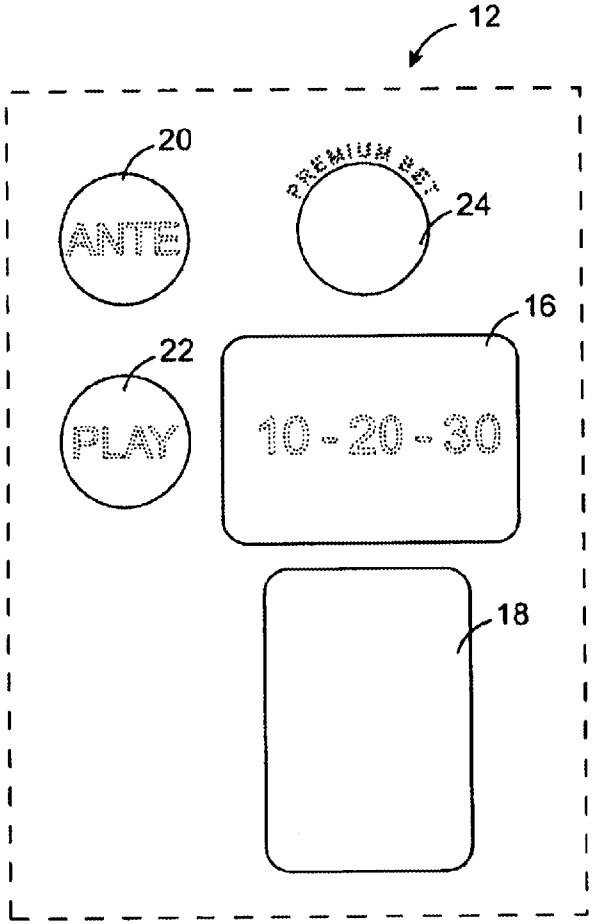

As shown in FIGS. 2 and 3, each station has a plurality of spots to place the player's wagers and to place the player's cards. In the illustrated station 12, there is a first section 16 to place a first subset of the cards. In exemplary embodiments, the first section receives the player's three cards that make the player's "qualifying hand" of 10, 20, or 30. A second section 18 of the station receives the player's two remaining cards or point hand. A first wager circle 20 if for receiving the ante wager. The player must place a minimum ante wager in the first wager circle 20 to be dealt cards. After the player has an opportunity to analyze the cards, the player can, if so desired, place a play wager in the second wager circle 22.

Optionally, in some stations, a third wager circle 24 can be positioned on the table to allow the player to make a bonus wager. In exemplary embodiments, the third wager circle 24 is there to allow the player to place a poker bonus wager, as will be described below. While not shown, a plurality of other wager circles can be placed on the table to allow the player to make additional bonus wagers, if desired.

Figure 4:
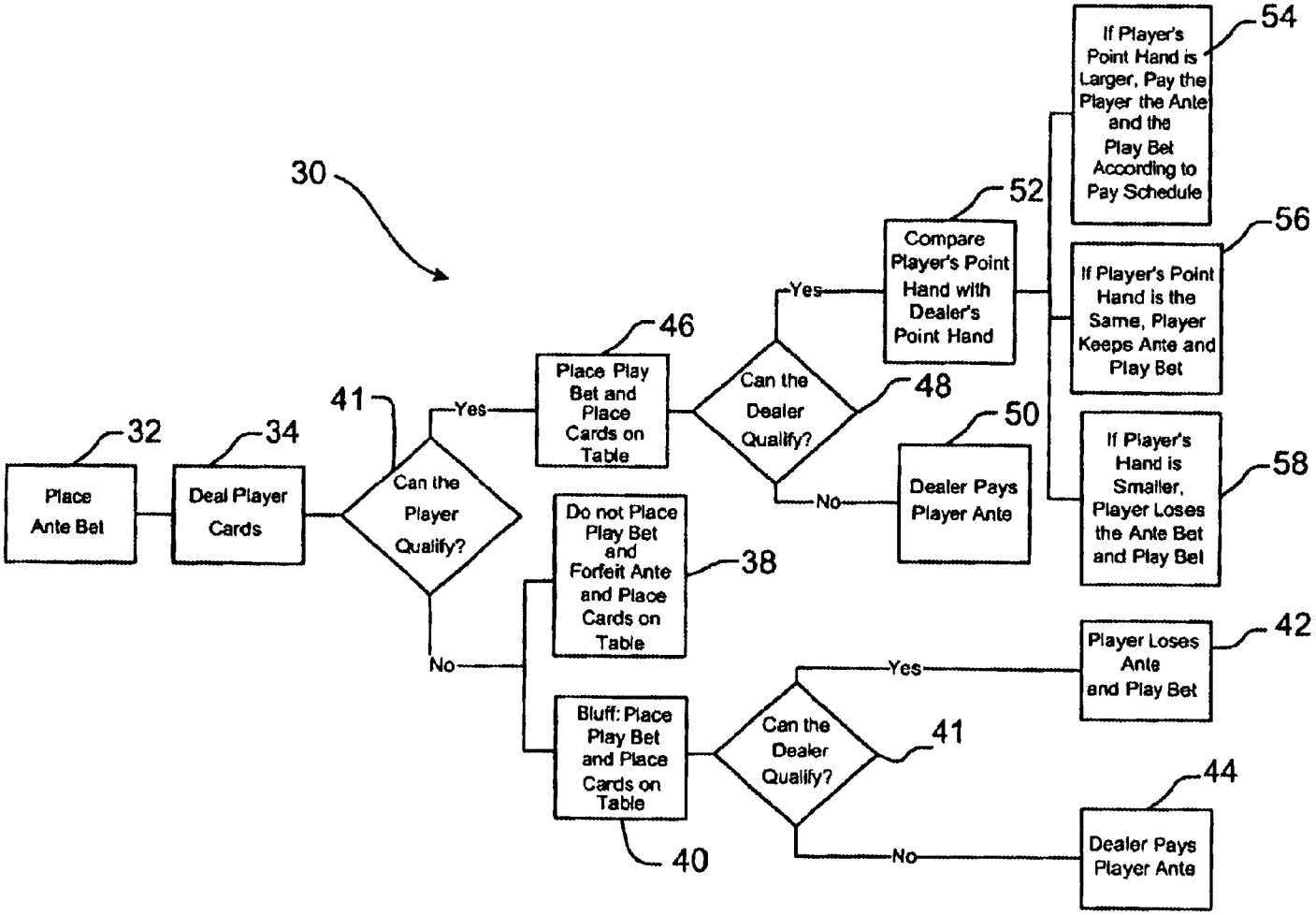
FIG. 4 illustrates one exemplary method of the present invention.

Some exemplary methods 30 of playing the game of the present invention will now be described in relation to FIGS. 4 and 5. In exemplary embodiments, for play in a casino, a dealer scrambles and shuffles at least one deck of cards. In some games, the casino may choose to use, 2, 3, 4, 5, or 6 decks of cards for the game. To receive cards, the player must place a minimum ante wager on the table (Step 32). The dealer deals a set of five cards face down to each player at the table who has placed an ante wager (Step 34). The player analyzes their cards to determine if they have a qualifying hand to make the required sum with their cards (Step 36). At this stage, the player will have a number of options.

If the player does not have a qualifying hand, the player can forfeit his ante wager (Step 38) or "bluff" in the hopes that the dealer too is unable to qualify (Step 40). If the player decides to forfeit his ante wager and fold, he places his cards face down on the table and the dealer will take the player's cards and ante wager.

If the player decides to bluff, the player must place a play wager in the designated spot on the player station and place his cards face down on the specified areas of the table. Having all of the cards faced down to the table allows the player to "bluff" and maintain his wager even if he wasn't able to qualify (e.g., reach the target of 10, 20, or 30). The dealer can then open his cards to determine if he is able to qualify (Step 41). If the dealer is able to qualify, the player loses both the ante wager and play wager (Step 42). If, however, the dealer is unable to qualify, the player will win his ante wager and will keep his play wager (Step 44).

If the player has a qualifying hand, the player can place a play wager and place the cards in their appropriate positions on the table to let the dealer know that he wishes to stay in the game (Step 46). In some situations, the player may wish to forfeit and not place a play wager, even if he is able to qualify. For example, if the player qualifies and has the lowest point hand, the player may wish to forfeit his ante wager.

When the dealer is satisfied that all of the players at the table have either forfeited or placed the play wager, the dealer opens his cards to determine if he can qualify (Step 48). The dealer then can show his hand and declare his point value or that he has not qualified.

In the event that the dealer does not qualify (e.g., not able to make a sum of 10, 20, or 30) with any three of the five dealt cards, the dealer declares such and pays each of the players on their ante wager—whether or not the player has a qualifying hand or not (Step 50).

In the event that the dealer is able to make a qualifying hand, the dealer calculates his point hand and opens each of the player's hands and compares the player's point hand against the dealer's point hand (Step 52). If the player's point hand is superior (e.g., higher), the dealer will pay the player his ante wager and pay the player his play wager (Step 54). As will be described in detail below, there are various pay schedules that can be used to pay the player on the play wager. If the player's point hand is equal to the dealer's point hand, the hand is declared a push and no money is exchanged (Step 56). In the event that the dealer's point hand is superior to the player's point hand, the dealer's hand is declared the winner and the player will lose his ante and play wager (Step 60).

Figure 5:
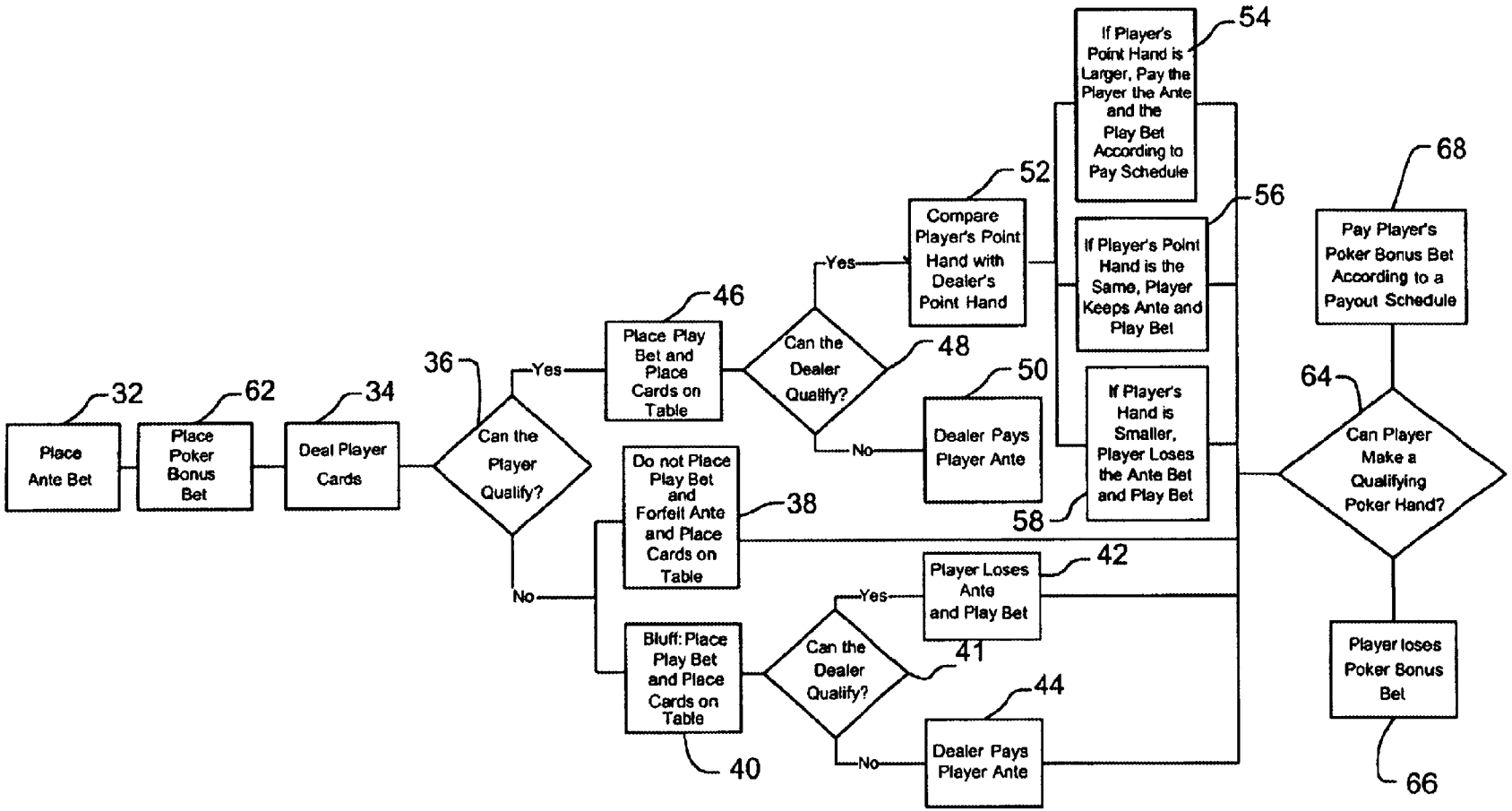
FIG. 5 illustrates another method of the present invention incorporating an optional poker bonus wager.

Optionally, as shown schematically in FIG. 5, the game 30 can be modified by allowing the player to place a poker bonus wager. The poker bonus wager allows the player to wager on a different aspect of the cards that are dealt to the player. Such a wager will typically be completely independent of whether the player can establish a qualifying hand.

However, in some embodiments, the house may choose to have the poker bonus wager paid out only if the player is able to establish a qualifying hand.

If the player is able to make a poker hand—four of a kind, royal flush, straight flush, full house, flush, straight, three of a kind, two pairs, pair, etc.—the player can be paid out on the poker bonus wager according to a schedule established by the house. What is determined a qualifying poker hand will vary from casino to casino. In some embodiments a qualifying poker hand will be a pair of jacks or better. In other embodiments, a qualifying poker hand will be a pair of jacks or better.

In one method, the player must place the poker bonus wager with the ante wager before the cards are dealt (Steps 32 and 62). Typically, the poker bonus wager will have a separate place on the table (FIGS. 1 to 3) to inform the dealer that the player is placing a poker bonus wager. Similar to above, after the player has been dealt the cards (Step 34), the player can determine if he is able to make a qualifying hand (Step 36). At this stage, the player will have the same options, as described above.

If the player does not have a qualifying hand, the player can forfeit his ante wager (Step 38) or "bluff" in the hopes that the dealer too is unable to qualify (Step 40). If the player decides to fold, he places his cards face down on the table and forfeits his ante. But instead of taking the player's cards, the dealer will check to see if the player has a qualifying poker hand (Step 64). If the player has a qualifying poker hand, the dealer will pay the player according to a payout schedule (Step 68). If the player does not have a qualifying poker hand, the player will lose his poker bonus wager (Step 66).

If the player does not have a qualifying hand but decides to bluff, the player must place a play wager and place his cards face down on the table on the specified areas. Because the player does not have an actual qualifying hand, the player can place any three cards in the qualifying area, and the remaining two cards in the point hand area. Having all of the cards faced down to the table allows the player to "bluff" and maintain his wagers even if he wasn't able to qualify (e.g., reach the target of 10, 20, or 30). The dealer can then open his cards to determine if he himself is able to qualify (Step 41). If the dealer is able to qualify, the player loses both the ante wager and play wager (Step 42). Thereafter, the dealer will check to see if the player can make a qualifying poker hand (Step 64). If the player has a qualifying poker hand, he will win his poker bonus wager according to a payout schedule (Step 68). If the player does not have a qualifying poker bonus wager, he will lose his poker bonus wager (Step 66).

If, however, the dealer is unable to qualify, the player will win his ante wager and will keep his play wager (Step 44). Similar to above, the dealer will then check to see if the player can make a qualifying poker hand (Step 64). If the player has a qualifying poker hand, he will win his poker bonus wager according to a payout schedule (Step 68). If the player does not have a qualifying poker bonus wager, he will lose his poker bonus wager (Step 66).

If the player has a qualifying hand, the player can place a play wager and place the cards in their appropriate positions on the table to let the dealer know that he wishes to stay in the game (Step 46). When the dealer is satisfied that all of the players at the table have either forfeited or placed the play wager, the dealer opens his cards to determine if he can qualify (Step 48). The dealer then can show his hand and declare his point value or that he has not qualified. In the event that the dealer does not qualify (i.e., not able to make a sum of 10, 20, or 30) with any three of the five dealt cards, the dealer declares such and pays each of the players on their ante wager—whether or not the player has a qualifying hand or not (Step 50) and then checks the player's cards to see if he has a qualifying poker hand (Step 64). If the player has a qualifying poker hand, he will win his poker bonus wager according to a payout schedule (Step 68). If the player does not have a qualifying poker bonus wager, he will lose his poker bonus wager (Step 66).

In the event that the dealer is able to make a qualifying hand, the dealer calculates his point hand and opens each of the player's hands and compares the player's point hand against the dealer's point hand (Step 52). If the player's point hand is superior (e.g., higher), the dealer will pay the player his ante wager and pay the player his play wager (Step 54). As will be described in detail below, there are various pay schedules that can be used to pay the player on the play wager. If the player's point hand is equal to the dealer's point hand, the hand is declared a push and no money is exchanged (Step 56). In the event that the dealer's point hand is superior to the player's point hand, the dealer's hand is declared the winner and the player will lose his ante and play wager (Step 60). In any of the cases, after the play wager has been settled, the dealer checks to see if the player can make a qualifying poker hand (Step 64).

In another aspect of the present invention, as another optional bonus wager, the table layout 10 can include another set of areas that allow the player to wager a "difference wager" on how much larger the player's point hand will be over the dealer's point hand. Typically the table layout 10 will have one or more circles for the player to place chips or money. For example, the player can place the difference wager that the player's point hand will be larger by at least 2 points, 3 points, 4 points, up to 9 points. If the player correctly guesses the difference between the player's and dealer's point hands, the player will win his ante wager, the play wager, and the optional "difference wager" according to a payout schedule.

In one specific method of the present invention, the player can make three or more additional bonus wagers on the hand. For example, assuming that the player places three additional bonus wagers based on the difference between the player's point hand and the dealer's point hand(e.g., two points, three points, and four points), if the player wins by one point, he can be paid even money on the ante wager and push all bonus wagers. If the player wins by two points, the player can win even money on the ante wager, even money on the first bonus wager, and push on all other additional bonus wagers. Each additional point difference can result in each additional wager paying even money.

In the event that the house is the winner, the above formula applies to determine if the player loses his bonus wagers. For example, assuming that the player has placed a wager betting that the difference between the player's point hand and dealer's point hand will be two points, in order for the player to lose the bonus wager the house must win by two points, or more. If the player or house does not win by the specific margin, no money changes hands.

In some embodiments, to improve the house's advantage, the dealer can take a 5% or other percentage, out of each of the player's winning hand. For example, if the dealer is not able to make a qualifying hand, the dealer will pay the player his ante minus a 5% commission.

The following example describes one specific method of play in a casino environment with the use of a deck of cards with a joker wild card. The dealer can scramble and strip a new, single deck of cards with one joker. The dealer may use an automatic card shuffle machine instead of a hand shuffle. The value of the cards can be valued as in baccarat: aces are 1 point, 2 through 9 have face value, and tens and face cards are worth 10. The joker is worth one point. For poker bonus wager, explained above, the card worth may differ.

Play begins when the player(s) make an ante wager. Typically the ante wager will be subject to table limits, which can be set by the casinos. To deal the cards, if desired, the dealer can place seven cards in front of him, face down, from left to right to each of the spots on the table. The eighth card starts at the left and continues until all stacks have five cards. The dealer can count the remaining cards, which should number 13 cards, to ensure that all 53 cards are accounted for. After all of the cards are accounted for, the remaining cards are placed in the discard rack.

The players then can examine their cards. Sharing of information with other players regarding the cards in their hand is discouraged. After examining his cards, the player has the option to either fold (e.g., forfeit the ante wager) or raise (e.g., place a play wager). If the player decides to fold, he must forfeit his cards and his ante wager. If the player decides to raise, he then must place an additional wager that is equal to his original wager in the designated area of the table. In some embodiments, the player maybe given the option to place a play wager that is less or more than the ante wager.

After all of the players have either forfeited or placed the play wager, each of the players can separate the five cards into a three-card "qualifying" hand and a two-card "point" hand. To have a qualifying hand, the player must have a point total of 10, 20, or 30 points in the three card hand. If the player cannot form a qualifying three card hand then his two card hand shall not matter and his only chance of winning is if the dealer does not have a qualifying hand.

If the three card hand qualifies, then the value of the two card point hand shall be based on the total points of the two cards. The highest possible value of the two card point hand 10 or 20, and shall have a value of 10. Otherwise, the value of the 2 card hand is the terminal digit in the total number of points, as in baccarat. For example, a player having a 6-card and a 9-card would have a total point value of 15, and a value of 5.

After the players have set their hands, the dealer shall arrange his cards into a three card hand and a two card hand in the same manner as the players. The dealer must try to qualify with 10, 20, or 30 point total in the three card hand. If the dealer does qualify, his two card point hand shall be valued in the same manner as the player's two card hand.

If the dealer's three card hand does not qualify then all players who did not forfeit their ante shall win even money on the ante, less a 5% commission if such a commission is implemented by the house, and the play wager will be considered a "push."

If both the player's and dealer's three card hands qualify, then the value of the two card hands shall determine the winner. If the dealer's two card point hand outscores the players two card point hand, then the player shall lose both the ante and play wager. In the even event of a tie, both the ante and play wager will be considered to be a "push." If the player's two card hand outscores the dealer's two card hand, then the player shall win even money on the ante, and the play wager can be paid according to the difference in the point value. One possible payout schedule for the play wager is as follows:

| Difference | Payout on Play Wager |
|---|---|
| 0 Points | Push |
| 1–3 Points | 1 to 1 |
| 4–6 Points | 2 to 1 |
| 7–9 Points | 3 to 1 |

Another possible payout schedule for the play wager is as folows:

| Difference | Payout on Play Wager |
|---|---|
| 0 Points | Push |
| 1–5 Points | 1 to1 |
| 6–9 Points | 2 to 1 |

It should be appreciated however, that the house may decide to use a 1 to 1 payout for all point differences between the player and dealer, if desired.

All winnings can be subject to a commission to the house, such as 5%. For example, if the player's two card hand has 7 points and the dealer's point hand has 2 points, then the player outscores the dealer by 5 points. Based on the above schedule, the player will receive 1 to 1 on the ante wager and 2 to 1 on the play wager, minus an optional 5% commission.

As noted above, some casinos can include a poker bonus wager that is independent of the outcome of the three card hand and two card point hand. For such games, the Joker is partially wild and may be used to complete a straight, flush, or straight flush, but is otherwise counted as an Ace. For the poker bonus wager, the house may choose to keep or waive the 5% commission. The Payout Tables illustrated in FIG. 6 provide some exemplary tables that can be used for the poker bonus wager (based on a $1 wager). If the table says "1" it means that the player is paid even money on his bet. If the table says "0" it means the player and house "push." If the table says "−1" it means that the player loses his poker bonus wager. The poker bonus wager can range from $1 to the house limits, or the limits set by the Gambling Commission in the state. The amount paid to the player for the qualifying poker hands can effect the edge that the house has over the player. For example, Payout Table #9 gives the house an edge of almost 50%, while Payout Table #7 gives the house only about a 7.5% edge. It should be appreciated that the payout tables are merely examples, and various other combinations of payouts for the different poker hands can be used in the casinos. For example, the only payout table that pays out for a pair of 8's or higher is table 18, but it should be appreciated that any of the other tables can be modified to pay out for a pair of eights or higher.

Figure 7:
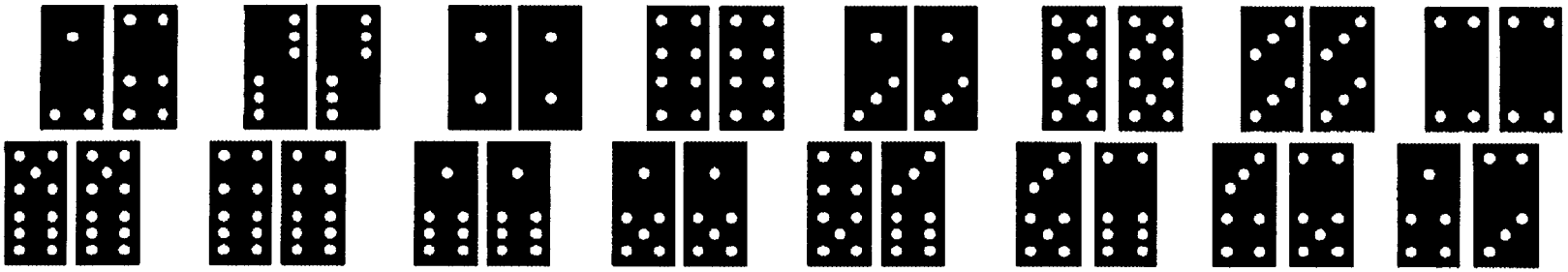
FIG. 7 illustrates a set of dominoes that can be used with the games of the present invention.

As noted above, the methods of the present invention can use other mediums, other than a standard deck of cards. For example, instead of using cards, the medium can be a set of dominoes. An exemplary set of dominoes are illustrated in FIG. 7. Additionally, the game may be played as a computer game at the casino or other gaming establishment, at home, over a network, or the like.

In one exemplary configuration, thirty two tiles or dominoes are used. FIG. 7 shows the 32 tiles that can be used,. Optionally, the game can include any number of wild cards, typically one or two. The wild cards will typically be changeable for only value. On the exemplary tile chart shown in FIG. 7 the two wild cards are the first pair rank (e.g., 3 and 6). When the 10, 20, or 30 is being formed with the dealt tiles, these two tiles count as either three or six. This give the player in some situations the flexibility to increase his point hand total by rearranging his 10-20-30 combinations. For example, if the player has two wild cards, two sevens and one 10, he would have a qualifying combination of twenty—7+7+6(wild) and two tiles 6(wild)+10=16 for the point hand. The other combination of twenty could be 7+3(wild)+10=20 and the two tile point hand would have a value of 3(wild)+7=10, which is considered the highest hand.

In most games, the player will compare his cards or tiles only against the dealer. However, in some games, the player may be given the option to "bank" such that the banking player plays as the house against the other players. In such games, the player must cover all wagers made by players. The bank will usually place a wager that is equal to the average wager by the player or the highest wager by any player for that wagering round. In rounds where the player is the "bank," any poker bonus wager that is placed by the other players are covered by the house. A five percent commission would still be payable to the house on any transaction.

As will understood by those of skill in the art, the present invention may be embodied in other specific forms without departing from the essential characteristics thereof. For example, instead of having the superior point hand be the higher point hand, the game can be modified to try to get the lowest point total. Additionally, instead of dealing five cards per hand, the game can be modified by dealing more cards (e.g., six or seven) or less cards (e.g., three of four cards). Accordingly, the foregoing description is intended to be illustrative, but not limiting, of the scope of the invention which is set forth in the following claims.

What is claimed is:

1. A method of playing a casino game, the method comprising:

providing a plurality of cards;

having a player place an ante wager;

dealing a set of five cards to a dealer and a set of five cards to the player;

determining if the player is able to make a qualifying hand with the dealt cards by attempting to select three of the five dealt cards to make a point total of 10, 20, or 30, wherein a point total of the two remaining cards is considered to be the player's point hand, wherein if the player is unable to make a qualifying hand the player can bluff or forfeit the ante wager;

placing a play wager if the player determines he has a qualifying hand or if the player decides to bluff;

placing the qualifying hand and the two point hand cards on a playing table;

determining if the dealer is able to make a qualifying hand with the dealt cards by attempting to select three of the five dealt cards to make a point total of 10, 20, or 30, wherein a point total of the two remaining cards is considered the dealer's point hand, wherein if the dealer is not able to make a qualifying hand, the player is paid on the ante wager; and comparing the point hand of the player with the point hand of the dealer, wherein if the dealer's point hand is superior to the player's point hand then the dealer wins and takes the players ante wager and play wager, and if the player's point hand is superior to the dealer's point hand the player is paid on the ante wager and the play wager, and wherein if the player's point hand is equal to the dealer's point hand the game is a push.

2. The method of claim 1 wherein if the dealer is not able to make a qualifying hand, the play wager is a push.

3. The method of claim 1 wherein the player is paid even money on the ante wager if the player's point hand is superior to the dealer's point hand.

4. The method of claim 1 wherein if the player's point hand is superior to the dealer's point hand, the method further comprising determining a point difference between the dealer's point hand and the player's point hand and paying the player on the play wager based on a sliding scale based on the point difference between the dealer's point hand and the player's point hand.

5. The method of claim 1 further comprising:

placing a poker bonus wager with the ante wager;

attempting to make a poker hand with the five dealt cards; and paying the player on the bonus wager if the player is able to make a qualifying poker hand, even if the player is not able to make a qualifying hand.

6. The method of claim 5 wherein a qualifying poker hand is a pair of jacks or higher.

7. The method of claim 5 wherein paying comprises following a preset payout schedule.

8. The method of claim 1 wherein the plurality of cards comprise a standard deck of cards with at least one wildcard.

9. A method of playing a casino game, the method comprising:

providing a plurality of dominoes;

having a player place a first wager;

dealing a set of dominoes to a dealer and the player;

determining if the player is able to make a qualifying hand with a subset of the dealt dominoes;

placing a second wager if the player determines he has a qualifying hand or if the player decides to bluff;

placing a first subset of the dealt dominoes and a second subset of the dealt dominoes on a playing table;

determining if the dealer is able to make a qualifying hand with the dealt dominoes, wherein if the dealer is able to make a qualifying hand the dealer places a first subset of the dealt dominoes on the table and compares a dealer's second subset with the player's second subset of dominoes such that if the player has a superior second subset the player wins on the first wager and second wager, wherein if the dealer has a superior second subset the player loses the first wager and the second wager.

10. The method of claim 9 comprising placing a poker bonus bet with the first wager.

11. The method of claim 10 comprising paying the player on the poker bonus bet if the player is able to make a qualifying poker hand with the dealt set of dominoes.

12. The method of claim 9 wherein the first subset comprises three dominoes and the second subset comprises two dominoes.

13. The method of claim 9 wherein the set of dominoes comprises 32 dominoes.

14. The method of claim 9 wherein the set of dominoes comprises a wildcard.

15. A method of playing a casino game, the method comprising:

providing a set of cards;

having a player place an ante wager and a poker bonus wager;

dealing a set of five cards to a dealer and a set of five cards to the player;

determining if the player is able to make a qualifying hand with the dealt cards by attempting to select three of the five dealt cards to make a point total of 10, 20, or 30, wherein a point total of the two remaining cards is considered to be the player's point hand, wherein if the player is unable to make a qualifying hand the player can bluff or forfeit the ante wager;

placing a play wager if the player determines he has a qualifying hand or if the player decides to bluff;

placing the three qualifying cards and the two point hand cards on a playing table;

determining if the dealer is able to make a qualifying hand with the dealt cards by attempting to select three of the five dealt cards to make a point total of 10, 20, or 30, wherein a point total of the two remaining cards is considered to be the dealer's point hand, wherein if the dealer is not able to make a qualifying hand, the player is paid on the ante wager;

comparing the point hand of the player with the point hand of the dealer, wherein if the dealer's point hand is superior to the player's point hand the dealer wins and takes the players ante wager and play wager, and if the player's point hand is superior to the dealer's point hand the player is paid on the ante wager and the play wager, and wherein if the player's point hand is equal to the dealer's point hand the game is a push;

determining of the player is able to make a qualifying poker hand, wherein determining is independent of whether the dealer or player can make a qualifying hand; and paying the player on the poker bonus wager if the player is able to make the qualifying poker hand, wherein the player loses the poker bonus wager if the player is not able to make the qualifying poker hand.

16. The method of claim 15 wherein paying the player on the poker bonus wager comprises following a payout schedule.

17. The method of claim 15 further comprising taking a commission of the amount paid on the ante wager and the play wager.

18. The method of claim 15 wherein a qualifying poker hand is a pair of jacks or better.

19. The method of claim 15 further comprising placing a difference bet regarding the difference between the dealer's point hand and the player's point hand.

* * * * *